US007472726B2

(12) United States Patent
Hack-Ueberall

(10) Patent No.: US 7,472,726 B2
(45) Date of Patent: Jan. 6, 2009

(54) PAPER MACHINE MESH

(75) Inventor: Petra Hack-Ueberall, Reutlingen (DE)

(73) Assignee: Voith Patent GmbH, Heidenheim (DE)

( * ) Notice: Subject to any disclaimer, the term of this patent is extended or adjusted under 35 U.S.C. 154(b) by 215 days.

(21) Appl. No.: 11/611,476

(22) Filed: Dec. 15, 2006

(65) Prior Publication Data

US 2007/0137721 A1 Jun. 21, 2007

(30) Foreign Application Priority Data

Dec. 16, 2005 (DE) ..... 10 2005 060 299

(51) Int. Cl.
*D21F 7/08* (2006.01)
*D03D 3/04* (2006.01)
*D03D 25/00* (2006.01)

(52) U.S. Cl. ..... 139/383 A; 139/383 AA; 162/358.2; 162/902

(58) Field of Classification Search ..... None
See application file for complete search history.

(56) References Cited

U.S. PATENT DOCUMENTS

| | | | | | |
|---|---|---|---|---|---|
| 4,041,989 | A * | 8/1977 | Johansson et al. | ..... | 139/425 A |
| 4,071,050 | A * | 1/1978 | Codorniu | ..... | 139/383 R |
| 4,564,051 | A * | 1/1986 | Odenthal | ..... | 139/425 A |
| 4,934,414 | A * | 6/1990 | Borel | ..... | 139/383 A |
| 5,092,372 | A * | 3/1992 | Fitzka et al. | ..... | 139/383 A |
| 5,151,316 | A * | 9/1992 | Durkin et al. | ..... | 428/213 |
| 5,152,326 | A * | 10/1992 | Vohringer | ..... | 139/383 A |
| 5,358,014 | A * | 10/1994 | Kovar | ..... | 139/383 A |
| 5,421,374 | A * | 6/1995 | Wright | ..... | 139/383 A |
| 5,465,764 | A * | 11/1995 | Eschmann et al. | ..... | 139/383 A |
| 5,902,672 | A | 5/1999 | Swoboda et al. | ..... | 428/258 |
| 6,202,705 | B1 * | 3/2001 | Johnson et al. | ..... | 139/383 A |
| 2003/0178087 | A1 * | 9/2003 | Odenthal | ..... | 139/383 A |
| 2003/0217782 | A1 * | 11/2003 | Nagura et al. | ..... | 139/383 A |
| 2004/0003860 | A1 * | 1/2004 | Taipale et al. | ..... | 139/383 A |
| 2004/0089363 | A1 * | 5/2004 | Josef et al. | ..... | 139/383 A |
| 2007/0028992 | A1 | 2/2007 | Westerkamp | ..... | 139/383 |

* cited by examiner

*Primary Examiner*—Bobby H Muromoto, Jr.
(74) *Attorney, Agent, or Firm*—Taylor & Aust, P.C.

(57) ABSTRACT

The present invention relates to a paper machine mesh, in particular a forming mesh, with an upper fabric layer the outer side of which forms a paper side of the paper machine mesh, wherein the lower fabric layer is formed by longitudinal threads and, woven therewith, lower transverse threads extending transverse to the longitudinal threads, wherein an upper weaving pattern, which is repeated in upper repeats, is formed by the weaving of the longitudinal threads with the upper transverse threads, wherein the longitudinal threads form, through weaving with the upper transverse threads, several upper longitudinal thread runs arranged side by side in the transverse thread direction with longitudinal thread lifts and longitudinal thread lowerings, wherein the longitudinal thread runs each extend over the length of the upper repeat in the longitudinal thread direction, wherein a longitudinal thread lift is formed in that a longitudinal thread respectively weaving with upper transverse threads continually crosses an upper transverse thread on the outer side of the upper fabric layer, and wherein a longitudinal thread lowering is formed in that a longitudinal thread respectively weaving with upper transverse threads continually crosses an upper transverse thread between the upper and lower fabric layer. The longitudinal thread lifts and longitudinal thread lowerings of the upper weaving pattern are arranged irregularly distributed in the upper repeat.

29 Claims, 6 Drawing Sheets a)

b)

= Warp is above So (warp lift)

= Warp runs below the Su (warp lowering)

a)

b)

PAPER MACHINE MESH

BACKGROUND OF THE INVENTION

1. Field of the Invention

This invention relates to a paper machine mesh, in particular a forming mesh.

2. Description of the Related Art

Forming meshes are used in the forming section of a paper machine. During the forming process, a fiber suspension from the headbox of the paper machine is applied to one forming mesh or to two forming meshes (in the case of gap formers). In this case, the forming mesh dewaters the fiber suspension and forms a fibrous web, wherein as little cellulose fiber and filler material as possible should be separated from the fiber suspension during the dewatering process.

The quality of the formed fibrous web is co-defined in this case to a great extent by the structure of the surface of the forming mesh facing the fibrous web (paper side).

In this case the forming meshes known from the prior art have a paper side which is generally formed by a linen bond. Such a linen bond often has a tendency, in particular for the production of graphic papers, to pronounced markings on the produced paper web.

What is needed in the art is a paper machine mesh on which the tendency to marking is reduced compared to the paper machine meshes known from the prior art.

SUMMARY OF THE INVENTION

A paper machine mesh, in particular forming mesh, has an upper fabric layer, the outer side of which forms a paper side of the paper machine mesh, wherein the upper fabric layer is formed by longitudinal threads and, woven therewith, upper transverse threads extending transverse to the longitudinal threads.

In this case an upper weaving pattern, which is repeated in upper repeats, is formed by the weaving of the longitudinal threads with the upper transverse threads. Through the weaving of the longitudinal threads with the upper transverse threads, several upper longitudinal thread runs arranged side by side in the transverse thread direction with longitudinal thread lifts and longitudinal thread lowerings are formed, each extending over the length of the upper repeat in the longitudinal thread direction.

A longitudinal thread lift is formed in this case in that a longitudinal thread, respectively weaving with upper transverse threads, continually crosses an upper transverse thread on the outer side of the upper fabric layer, and a longitudinal thread lowering is formed in that a longitudinal thread, respectively weaving with upper transverse threads, continually crosses an upper transverse thread between the upper and lower fabric layer.

The paper machine mesh of the present invention is characterized in that the longitudinal thread lifts and longitudinal thread lowerings of the upper weaving pattern are arranged irregularly distributed in the upper repeat.

By providing an irregularly constructed paper-side weaving structure, the pronounced diagonal structure, which has often led on the meshes known from the prior art to a high tendency to marking, is interrupted for example. The reduced tendency to marking is notable in an improved printability in particular in the case of graphic papers.

Various possibilities for constructing an irregular structure of the upper weaving pattern are possible.

A first embodiment of the present invention provides for the irregular structure to be formed in that, in the upper repeat, at least two upper longitudinal thread runs are constructed such that it is not possible for the one of the two longitudinal thread runs to be formed by offsetting all of its longitudinal thread lifts and lowerings by an identical number of upper transverse threads in the longitudinal thread direction from the other of the two longitudinal thread runs.

To obtain a nearly completely irregular paper side of the inventive mesh, another aspect of the invention provides for the upper weaving pattern to have an irregular structure in that none of the upper longitudinal thread runs in the upper repeat can be produced by offsetting all of its longitudinal thread lifts and longitudinal thread lowerings by an identical number of upper transverse threads in the longitudinal thread direction from another upper longitudinal thread run of the repeat. Such bonds are referred to as crêpe bonds.

To obtain a large possible variation in the design of the irregular upper weaving structure, the upper repeat should include at least 5 longitudinal thread runs.

According to another embodiment of the present invention, the irregular paper-side weaving structure can also be provided in that the upper weaving structure includes a number of mutually different longitudinal thread runs, wherein the number of the mutually different longitudinal thread runs is smaller than the number of longitudinal thread runs forming the upper repeat.

On this embodiment, the mutually different longitudinal thread runs are arranged in a non-repeating sequence over the entire upper repeat. The longitudinal thread repeat thus produced can then be very large, including 12 longitudinal thread runs for example, wherein the number of mutually different longitudinal thread runs amounts to only four for example. This means that a bond with a very large repeat can be woven with only a very small number of shafts for the paper side. The sequence of the longitudinal thread runs can be for example:

1-2-3-1-4-1-2-3-4-2-3-1

Such a bond is also referred to as a crêpe bond.

The upper fabric layer includes in this case upper transverse threads or upper transverse threads and tie threads, which have a diameter in the range from 0.03 mm to 0.5 mm, preferably 0.08 mm to 0.15 mm. A particularly fine and marking-free paper side can thus be produced.

The number of longitudinal thread lifts and longitudinal thread lowerings in the upper repeat is essentially identical. The paper side is thus dominated by neither longitudinal thread lifts nor longitudinal thread lowerings, resulting in an on the whole flat paper side with an irregular structure and therefore a further reduced tendency to marking.

In terms of bonding technique, the irregular structure of the upper fabric layer can be formed, either alone or in combination, by: free textile development, changing a basic textile bond, deriving a basic textile bond, extending a basic textile bond.

Various possibilities for the construction of the inventive paper machine mesh are possible. For example, the paper machine mesh can be formed by only one longitudinal thread layer and by only one transverse thread layer.

To increase the life of the paper machine mesh, provision is made for the paper machine mesh to include a lower fabric layer whose outer side forms the machine side of the paper machine mesh.

In this case the paper machine mesh can include two longitudinal thread layers and one transverse thread layer for example or, vice versa, two transverse thread layers and only one longitudinal thread layer. Also possible, however, are other embodiments on which two or more longitudinal thread layers and/or two or more transverse thread layers are provided.

It is also possible, however, for the machine side to be formed by a non-woven structure for example, providing a corresponding wear volume. For example, a fleece layer or a foil are possible.

In this case, and also when a woven structure is provided, the upper fabric laser can be connected to the layer forming the machine side by bonding or melting for example.

If the lower layer is constructed as a fabric, then the longitudinal threads of the inventive paper machine mesh include tie threads which connect the upper and the lower fabric layer to each other, meaning the upper fabric layer includes not only longitudinal threads woven with only the upper transverse threads but also tie threads which are woven with lower and upper transverse threads. In this case the tie threads are an integral component of the weaving structure of the upper fabric layer (integral tie threads), as the result of which a tendency to marking due to the tying of the tie threads is reduced.

The tie threads are arranged in groups, wherein each group of tie threads forms an upper longitudinal thread run in that the tie threads of the group are woven alternately in sections with the upper transverse threads in the longitudinal thread direction.

According to another embodiment of the present invention, the upper fabric layer is formed only by the tie threads arranged in groups and the upper transverse thread woven therewith.

Another embodiment of the present invention provides for the lower fabric layer to be formed by longitudinal threads and, woven therewith, lower transverse threads extending transverse to the longitudinal threads. The longitudinal threads in this case are constructed at least in part as tie threads such that the lower fabric layer includes tie threads which are woven with lower transverse threads.

A further aspect of the present invention provides for each lower transverse thread to be held respectively by several tie threads in that each of these tie threads continually crosses the respective lower transverse thread on the outer side of the lower fabric layer, wherein some of the tie threads holding a respective lower transverse thread are separated from each other by at least one tie thread not holding the respective lower transverse thread in that the non-holding tie thread does not continually cross the respective lower transverse thread on the outer side of the lower fabric layer, and wherein provision is made for several lower transverse threads for which an identical number of non-holding tie threads is arranged respectively between consecutive tie threads holding the respective lower transverse thread.

For several of the lower transverse threads, an identical number of non-holding tie threads is always arranged between consecutive tie threads respectively holding the lower transverse thread, hence each of these transverse threads always has the same floating length on the outer side of the lower fabric, meaning on the machine side, of the paper machine mesh, between consecutive points at which said transverse thread is held by a tie thread, so-called tie points of the upper fabric to the lower fabric.

The identical floating lengths of the transverse threads between the tie points provides a uniformly distributed connection of the upper fabric layer to the lower fabric layer, thus providing a paper machine mesh with a significantly improved flatness of the machine side and paper side with regard to the prior art.

Owing to the uniform distribution of the tie points it is possible in addition to distribute the holding force uniformly, thus enabling a significantly stronger connection between the two fabric layers to be obtained, as the result of which their relative movement can be reduced to a minimum, which leads to a minimization of the inner wear of the paper machine mesh of the present invention.

Furthermore, the uniform distribution of the tie points and the stronger connection of the upper fabric layer to the lower fabric layer thus made possible leads to a reduced overall thickness of the inventive paper machine mesh compared to the meshes known from the prior art.

The identical floating lengths of the transverse threads between the tie points also produces a uniformly distributed wear volume of the lower transverse threads extending on the outer side of the lower fabric (machine side), which thus protect the load-bearing tie threads.

Hence it is possible that for one lower transverse thread the number of non-holding tie threads arranged between consecutive holding tie threads is five and for another lower transverse thread seven.

According to an embodiment of the present invention based thereon, for each lower transverse thread between consecutive tie threads respectively holding the lower transverse thread provision is made to arrange an identical number of tie threads not holding the transverse thread. Because all lower transverse threads always have an identical floating length both in respect of themselves and with regard to the other transverse threads, the uniformity of the tie points is further increased, thus intensifying the previously described positive effects on this embodiment.

The number of tie threads not holding the respective transverse thread amounts to between two and twenty, preferably between six and ten. Tests have shown that given identical floating lengths of between two and twenty, tie threads not holding the respective lower transverse thread can provide a good connection between the upper and lower fabric layer paired with an improved wear resistance, in particular for use on paper machines at speeds of 1500 m/min or more.

Another embodiment of the present invention provides for the tie threads of each group to cross when switching from weaving with the upper transverse threads to weaving with the lower transverse threads and vice versa, thus forming intersections, wherein tie threads of at least one group are woven with the upper and lower transverse threads such that at least two consecutive intersections are arranged over the length of the upper repeat in the longitudinal thread direction.

By providing at least two consecutive intersections per paper-side longitudinal thread repeat, a high tie frequency between the paper-side fabric and the running-side fabric is created, as the result of which a firm connection between the upper fabric layer and the lower fabric layer is provided.

To provide a paper side with good fiber support on the one hand and an open machine side for good dewatering of the paper machine mesh on the other hand, provision is made in accordance with a particularly advantageous further aspect of the invention for the ratio of upper transverse threads to lower transverse threads to be greater than 1, in particular 2:1, 3:2 or 4:3.

According to a concrete embodiment of the present invention, the upper fabric layer of the paper machine mesh has fourteen or more upper transverse threads. Furthermore, the lower fabric layer includes seven or more lower transverse threads. The tie threads in this case are arranged in seven groups of two tie threads each.

For greater flexibility in the construction of the upper and lower fabric layer of the paper machine mesh, the complete repeat is formed by a multiplicity of longitudinal threads and/or upper and lower transverse threads. In concrete terms, the complete repeat of the paper machine mesh can include for example 24 or more, or 26 or more, or 32 or more, or 48 or more longitudinal threads and/or 24 or more, or 26 or more, or 32 or more, or 48 or more upper and lower transverse threads.

According to a concrete embodiment of the present invention, the tie threads are warp threads and the transverse threads are weft threads. In this case the system is a warp-tied system. However, it is also possible for the tie threads to be weft threads and the transverse threads to be warp threads. In this case the system is a weft-tied system.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, in one form, and such exemplifications are not to be construed as limiting the scope of the invention in any manner.

DETAILED DESCRIPTION OF THE INVENTION

Figure 1:
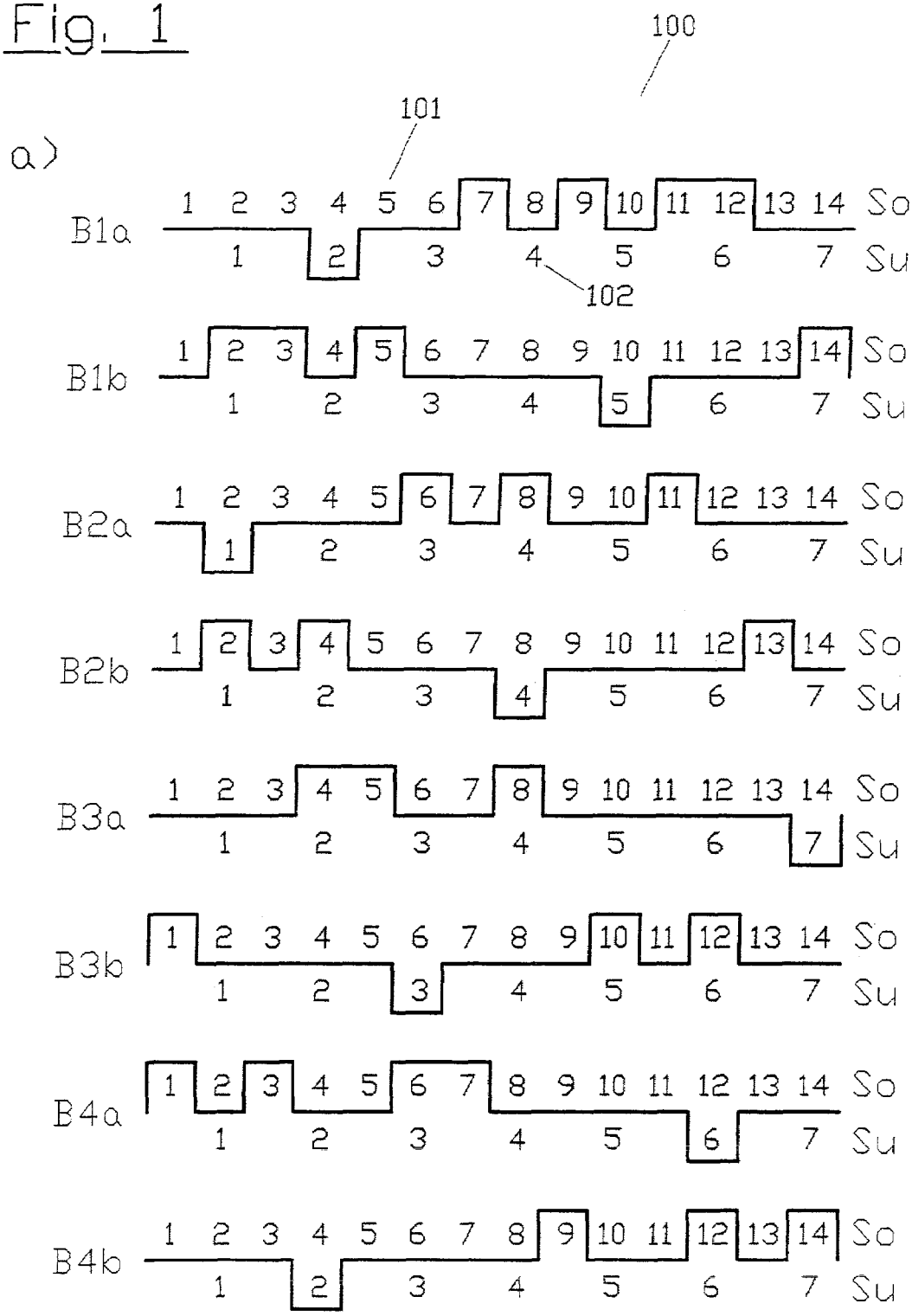
FIGS. 1*a*-1*b* shows the warp thread run of an embodiment of an inventive paper machine mesh.
Figure 1:
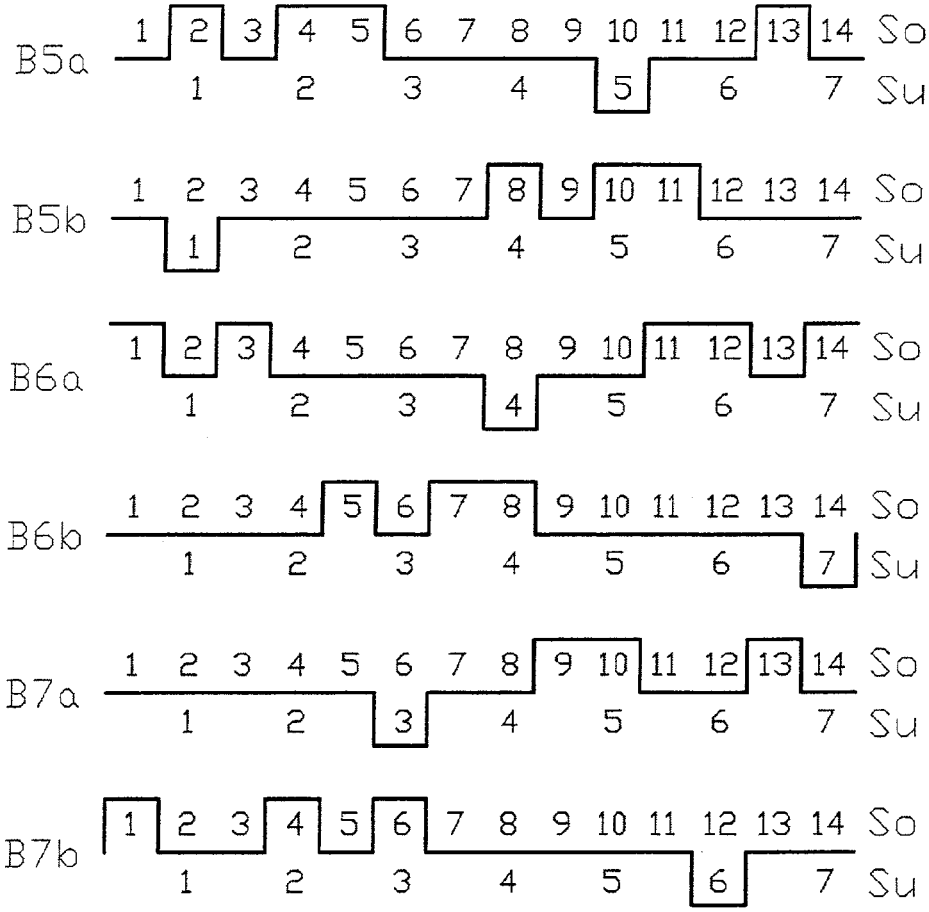
Figure 1:
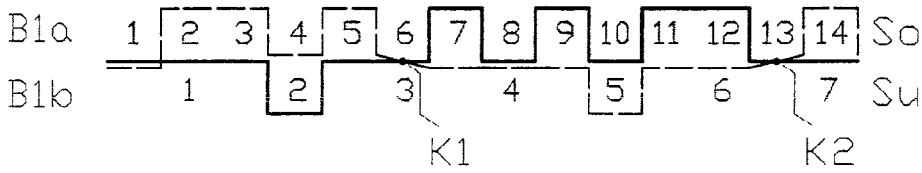

Referring now to the drawings, and more particularly to FIGS. 1*a*-1*b*, there is shown, in the longitudinal direction, a paper machine mesh 100 constructed as a forming mesh, wherein the longitudinal thread direction corresponds to the warp thread direction of the mesh 100.

The representation in FIG. 1*a* shows a complete repeat of the weaving structure of the forming mesh 100.

The illustrated forming mesh 100 includes upper transverse threads SO1 to SO14 and lower transverse threads SU1 to SU7, which are constructed respectively as weft threads.

As is evident from FIG. 1*a*, the ratio of the upper transverse threads SO1 to SO14 to the lower transverse threads SU1 to SU7 is 2:1.

Furthermore, the forming mesh 100 includes tie threads B1*a* to B7*b* constructed as warp threads, wherein the tie threads are arranged in groups of tie thread pairs B1*a* and B1*b*, B2*a* and B2*b* . . . .

The tie threads are woven not only with the upper transverse threads SO1 to SO14 but also with the lower transverse threads SU1 to SU7.

Figure 2:
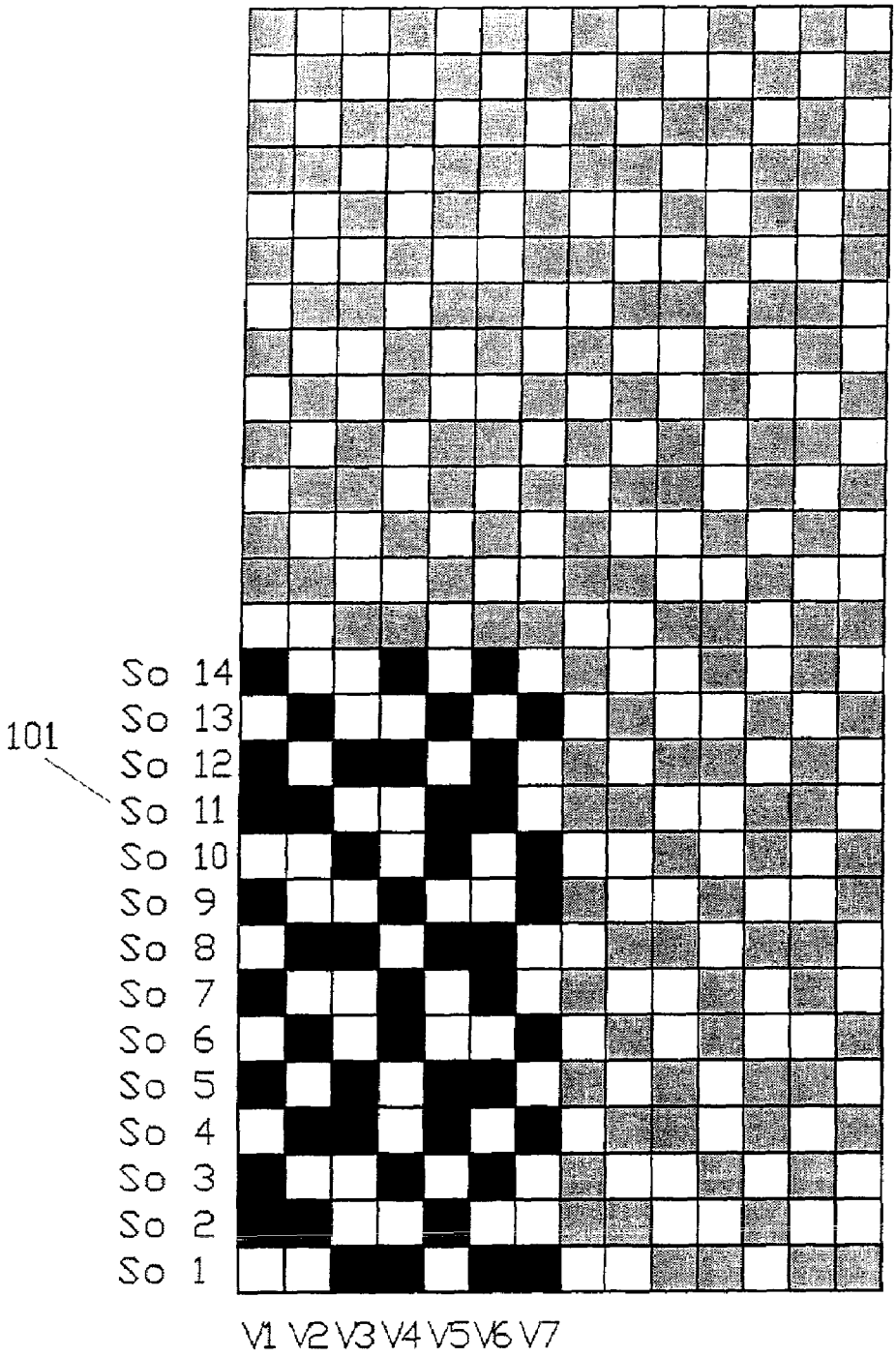
FIG. 2 is a representation of the paper side of the paper machine mesh from FIGS. 1*a*-1*b* with warp lifts and lowerings.
Figure 3:
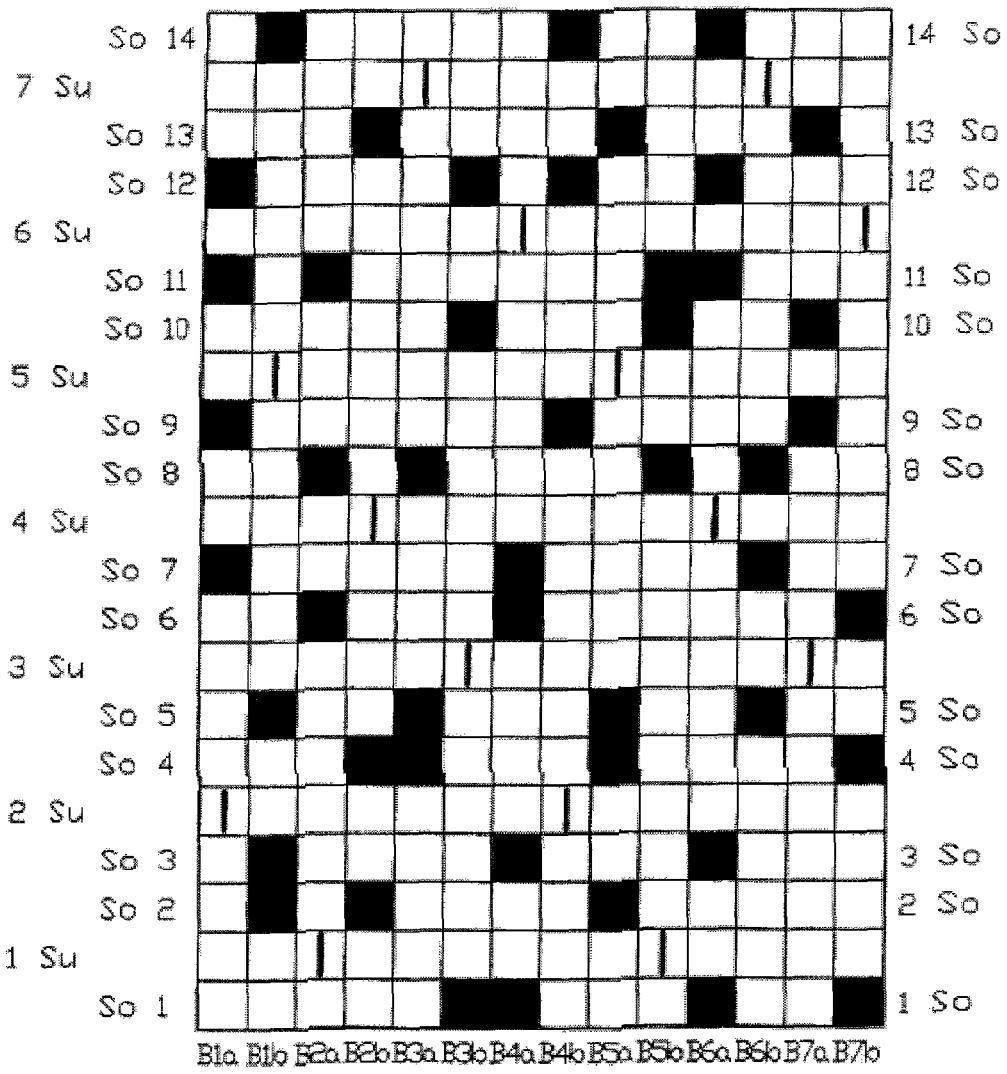
FIG. 3 is a representation of the paper side and machine side of the paper machine mesh from FIGS. 1*a*-1*b*.

Weaving the tie threads B1*a* to B7*b* with the upper transverse threads SO1 to SO14 forms an upper fabric layer whose weaving pattern is repeated in upper repeats, as is evident in particular from FIGS. 2 and 3, wherein the upper repeat extends in the longitudinal thread direction over the upper transverse threads SO1 to SO14 and in the transverse thread direction over the tie threads B1*a* to B7*b*. In this case the upper fabric layer has an outer side 101 which forms the paper side of the forming mesh 100.

Weaving the tie threads B1*a* to B7*b* with the lower transverse threads SU1 to SU7 forms a lower fabric layer whose weaving pattern is repeated in lower repeats, wherein the lower repeat extends in the longitudinal thread direction over the lower transverse threads SU1 to SU7 and in the transverse thread direction over the tie threads B1*a* to B7*b*. The lower fabric layer includes in addition an outer side 102 which forms the machine side of the forming mesh 100.

Accordingly, each tie thread B1*a* to B7*b* is woven alternately in sections with lower transverse threads and with upper transverse threads.

Because the tie threads B1*a* to B7*b* are woven with the lower and upper transverse threads, they connect the upper fabric layer to the lower fabric layer. In this case each lower transverse thread is held respectively by several tie threads in that each of these tie threads continually crosses the respective lower transverse thread on the outer side 102 of the lower fabric layer, wherein all of the tie threads holding a respective lower transverse thread are separated from each other by six tie threads not holding the lower transverse thread in that the lower transverse thread continually crosses the non-holding tie thread on the outer side 102 of the lower fabric layer. Hence, for all lower transverse threads between consecutive tie threads respectively holding the lower transverse thread there is always arranged an identical number of non-holding tie threads.

For example, the lower transverse thread SU2 is held in the complete repeat by the tie threads B1*a* and B4*b*, wherein between the holding tie threads B1*a* and B4*b* there are arranged the non-holding tie threads B1*b*, B2*a*, B2*b*, B3*a*, B3*b* and B4*a*, and further in the transverse thread direction of the repeat between the holding tie threads B4*b* and B1*a* there are arranged the non-holding tie threads B5*a*, B5*b*, B6*a*, B6*b*, B7*a* and B7*b*.

In addition, the lower transverse thread SU1 for example is held in the complete repeat by the tie threads B2*a* and B5*b*, wherein between the holding tie threads B2*a* and B5*b* there are arranged the non-holding tie threads B2*b*, B3*a*, B3*b*, B4*a*, B4*b* and B5*a*, and further in the transverse thread direction of the repeat between the holding tie threads B5*b* and B2*a* there are arranged the non-holding tie threads B6*a*, B6*b*, B7*a*, B7*b*, B1*a* and B1*b*.

Hence for each lower transverse thread between consecutive holding tie threads there is always arranged an identical number of non-holding tie threads.

Furthermore, the number of non-holding tie threads is identical for all transverse threads and amounts in the embodiment in question to six.

As previously mentioned, weaving the tie threads B1*a* to B7*b* with the upper transverse threads SO1 to SO14 forms an upper weaving pattern which is repeated in upper repeats, wherein the tie threads B1*a* to B7*b* are arranged in groups.

As is evident from FIGS. 1*a*-1*b*, the tie threads of each group, for example B1*a* and B1*b*, alternate in sections in the longitudinal direction during weaving with the upper transverse threads SO1 SO14, as the result of which each group of tie threads B1*a* and B1*b*, B2*a* and B2*b*, B3*a* and B3*b*, B4*a* and B4*b*, B5*a* and B5*b*, B6*a* and B6*b*, B7*a* and B7*b* forms by weaving with the upper transverse threads SO1 to SO14 an upper longitudinal thread run V1 to V7 with tie thread lifts (black boxes in FIG. 2) and tie thread lowerings (white boxes in FIG. 2).

Hence one tie thread of the group weaves with the upper transverse threads when the other tie thread of the group weaves with the lower transverse threads and vice versa. In addition, the tie threads of each group cross each other when switching from weaving with lower transverse threads to weaving with upper transverse threads at intersections, as is evident for example from FIG. 1*b* in which the two tie threads B1*a* and B1*b* cross at the intersections K1 and K2.

Here the tie threads of each group are woven with the upper transverse threads SO1 to SO14 and with the lower transverse threads SU1 to SU7 such that two intersections are arranged over the length of the upper repeat.

For example, the tie thread pair B1*a* and B1*b* forms, by weaving with the upper transverse threads SO1 to SO14, the upper longitudinal thread run V1, which is repeated in the longitudinal thread direction according to the length of the upper repeat.

A tie thread lift is formed in this case in that the tie thread of a group respectively weaving with upper transverse threads, for example B1*a*, continually crosses an upper transverse thread on the outer side 101 of the upper fabric layer. A tie thread lowering is formed in this case in that the tie thread of a group respectively weaving with upper transverse threads, for example B1*a*, continually crosses an upper transverse thread between the upper and lower fabric layer.

FIG. 2 shows a schematic plan view of the outer side 101 of the upper fabric layer forming the paper side. As is evident in particular from FIG. 2, the upper repeat is formed by the upper longitudinal thread runs V1 to V7 along the upper transverse threads SO1 to SO14.

The paper side 101 has an irregular structure such that none of the upper longitudinal thread runs V1 to V7 in the upper repeat can be formed by offsetting all of its longitudinal thread lifts (black boxes) and longitudinal thread lowerings (white boxes) by an identical number of upper transverse threads in the longitudinal thread direction from another upper longitudinal thread run V1 to V7 of the repeat. For example, the longitudinal thread run V1 cannot be produced by shifting any of the other longitudinal thread runs V2 to V7 by a number of transverse threads.

FIG. 3 shows a representation of the paper side and machine side of the inventive forming mesh 100.

Black boxes at intersections of tie threads (B) with upper transverse threads (SO) represent tie thread lifts of the paper side, and white boxes at intersections of tie threads (B) with upper transverse threads (SO) represent tie thread lowerings of the paper side.

In addition, white boxes at intersections of tie threads (B) with lower transverse threads (SO) represent points at which the respective lower transverse thread runs on the outer side of the lower fabric layer, meaning on the machine side, and boxes with a vertical bar represent intersections at which the respective tie thread (B) runs on the outer side of the lower fabric layer, meaning the machine side, meaning a lower transverse thread is held by the tie thread.

Figure 4:
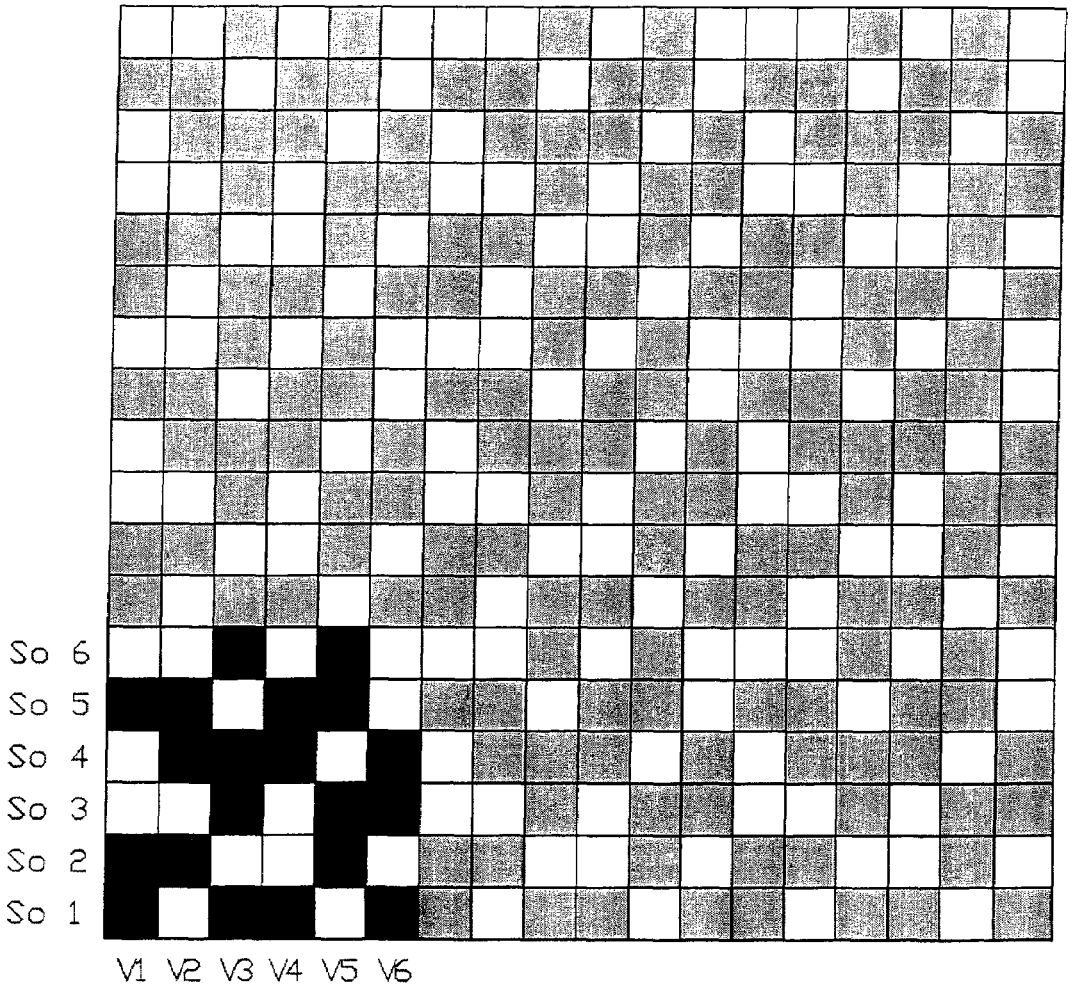
FIGS. 4*a*-4*b* shows more embodiments of irregularly constructed paper sides.
Figure 4:
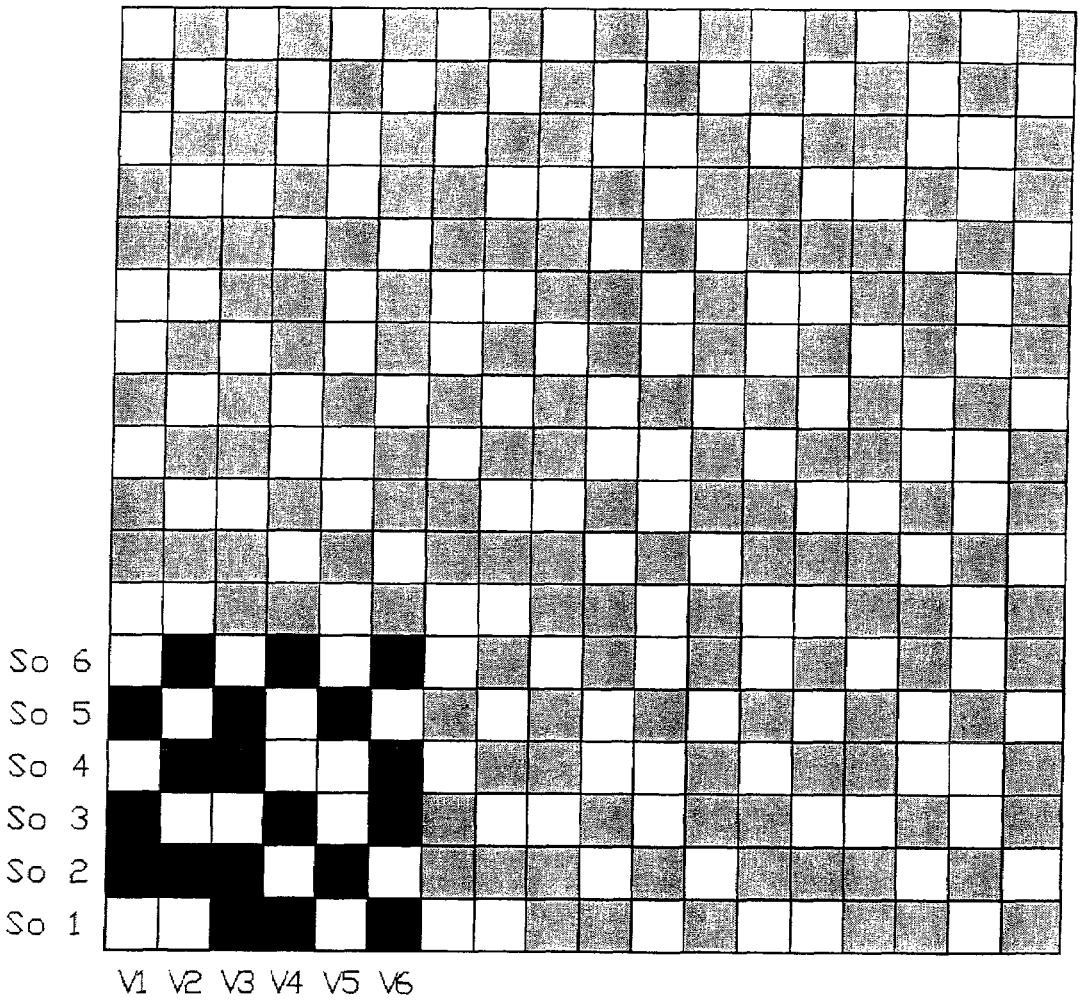

FIG. 4*a* shows a schematic plan view of the paper side of another embodiment of an inventive paper machine mesh. As is evident in particular from FIG. 4*a*, the upper repeat is formed by the upper longitudinal thread runs V1 to V6 along the upper transverse threads SO1 to SO6.

The paper side 101 has an irregular structure in that, in the upper repeat, at least two upper longitudinal thread runs are constructed such that it is not possible for the one of the two longitudinal thread runs to be formed by offsetting all of its longitudinal thread lifts and lowerings by an identical number of upper transverse threads in the longitudinal thread direction from the other of the two longitudinal thread runs.

For example, the longitudinal thread run V2 cannot be produced by shifting by a number of transverse threads from the longitudinal thread run V3 because the longitudinal thread run V2 includes three longitudinal thread lifts and three longitudinal thread lowerings whereas the longitudinal thread run V3 has four longitudinal thread lifts and only two longitudinal thread lowerings.

Similarly, the paper-side weaving pattern presented in FIG. 4*b* is irregular within the meaning of the invention because, for example, the longitudinal thread run V1 cannot be produced by shifting by a number of transverse threads from the longitudinal thread run V2. The longitudinal thread run V1 has three longitudinal thread lifts, two of which are arranged directly side by side, whereas the longitudinal thread run V2 has three longitudinal thread lifts, which are separated from each other in each case by one longitudinal thread lowering.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine mesh comprising:

an upper fabric layer having an outer side which forms a paper side of the paper machine mesh, said upper fabric layer including a plurality of upper transverse threads; and a lower fabric layer comprising a plurality of longitudinal threads and, woven therewith, a plurality of lower transverse threads extending transverse to said plurality of longitudinal threads, wherein said upper fabric layer includes an upper weaving pattern, which is repeated in a plurality of upper repeats, comprising weaving of said plurality of longitudinal threads with said plurality of upper transverse threads, wherein said plurality of longitudinal threads include, through weaving with said plurality of upper transverse threads, a plurality of upper longitudinal thread runs arranged side by side in a transverse thread direction with a plurality of longitudinal thread lifts and a plurality of longitudinal thread lowerings of said upper weaving pattern, wherein each of said plurality of upper longitudinal thread runs extends over a length of each of said plurality of upper repeats in a longitudinal thread direction, wherein each of said plurality of longitudinal thread lifts comprises respective said plurality of longitudinal threads respectively weaving with said plurality of upper transverse threads continually crossing respective said plurality of upper transverse threads on said outer side of said upper fabric layer, wherein each of said plurality of longitudinal thread lowerings comprises respective said plurality of longitudinal threads respectively weaving with said plurality of upper transverse threads continually crossing respective said plurality of upper transverse threads between said upper fabric layer and said lower fabric layer, and wherein said plurality of longitudinal thread lifts and said plurality of longitudinal thread lowerings of said upper weaving pattern are arranged irregularly distributed in said plurality of upper repeats.

2. The paper machine mesh according to claim 1, wherein said upper weaving pattern has an irregular structure comprising at least two of said plurality of upper longitudinal thread runs in each of said plurality of upper repeats, said at least two of said plurality of upper longitudinal threads including a first upper longitudinal thread run and a second upper longitudinal thread run, wherein said first upper longitudinal thread run cannot be produced by offsetting all of said plurality of longitudinal thread lifts and said plurality of longitudinal thread lowerings of said first upper longitudinal thread run by an identical number of said plurality of upper transverse threads in said longitudinal thread direction from said second upper longitudinal thread run.

3. The paper machine covering according to claim 2, wherein said upper longitudinal thread runs include a plurality of tie thread lifts and a plurality of tie thread lowerings, wherein said upper weaving pattern has an irregular structure in that none of said plurality of upper longitudinal thread runs in each of said plurality of upper repeats can be produced by offsetting all of said plurality of tie thread lifts and said plurality of tie thread lowerings of respective said plurality of upper longitudinal thread runs by an identical number of said plurality of upper transverse threads in said longitudinal thread direction from another of said plurality of upper longitudinal thread runs of each of said plurality of upper repeats.

4. The paper machine mesh according to claim 2, wherein said irregular structure of said upper weaving pattern formed, one of alone and in combination, at least one of by a free textile development, changing a basic textile bond, deriving a basic textile bond, and extending a basic textile bond.

5. The paper machine mesh according to claim 1, wherein said upper weaving pattern has an irregular structure in that said structure comprises a number of mutually different said plurality of upper longitudinal thread runs, wherein said number of mutually different said plurality of upper longitudinal thread runs is smaller than a number of said plurality of upper longitudinal thread runs forming each of said plurality of upper repeats.

6. The paper machine mesh according to claim 5, wherein said plurality of longitudinal thread lifts and said plurality of longitudinal thread lowerings in said plurality of upper repeats comprises an essentially identical number.

7. The paper machine mesh according to claim 1, wherein said lower fabric layer includes an outer side comprising a machine side of the paper machine mesh.

8. The paper machine mesh according to claim 7, wherein said plurality of longitudinal threads comprises a plurality of tie threads which connect said upper fabric layer and said lower fabric layer to each other.

9. The paper machine mesh according to claim 8, wherein said plurality of tie threads are arranged in a plurality of groups, wherein each of said plurality of groups of said plurality of tie threads comprises respective of said plurality of upper longitudinal thread runs in that said plurality of tie threads of respective of said plurality of groups is woven alternately in a plurality of sections with said plurality of upper transverse threads in said longitudinal thread direction.

10. The paper machine mesh according to claim 9, wherein said lower fabric layer comprises said plurality of longitudinal threads and, woven therewith, said plurality of lower transverse threads extending transverse to said plurality of longitudinal threads.

11. The paper machine mesh according to claim 10, wherein said lower fabric layer comprises said plurality of tie threads which are woven with said plurality of lower transverse threads.

12. The paper machine mesh according to claim 11, wherein each of said plurality of lower transverse threads is held respectively by several of said plurality of tie threads in that each of said several of said plurality of tie threads continually crosses respective said plurality of lower transverse threads on said outer side of said lower fabric layer, wherein some of said plurality of tie threads holding respective said plurality of lower transverse threads are separated from each other by at least one of said plurality of tie threads not holding respective said plurality of lower transverse threads in that said at least one of said plurality of tie threads not holding respective said plurality of lower transverse threads does not continually cross respective said plurality of lower transverse threads on said outer side of said lower fabric layer, wherein several of said plurality of lower transverse threads include an identical number of said at least one of said plurality of tie threads not holding respective said plurality of lower transverse threads arranged respectively between consecutive said plurality of tie threads holding respective said plurality of lower transverse threads.

13. The paper machine mesh according to claim 12, wherein for each of said plurality of lower transverse threads between consecutive said plurality of tie threads holding respective said plurality of lower transverse threads there is always arranged an identical number of said at least one of said plurality of tie threads not holding respective said plurality of lower transverse threads.

14. The paper machine mesh according to claim 12, wherein a number of said at least one of said plurality of tie threads not holding respective said plurality of lower transverse threads amounts to between two and twenty.

15. The paper machine mesh according to claim 12, wherein a number of said at least one of said plurality of tie threads not holding respective said plurality of lower transverse threads amounts to between six and ten.

16. The paper machine mesh according to claim 14, wherein said plurality of tie threads of each of said plurality of groups comprise a plurality of intersections which includes said plurality of tie threads respectively of each of said plurality of groups crossing when switching from weaving with said plurality of upper transverse threads to weaving with said plurality of lower transverse threads and vice versa, wherein said plurality of tie threads of at least one of said plurality of groups are woven with said plurality of upper and said plurality of lower transverse threads such that at least two consecutive said plurality of intersections are arranged over said length of each of said plurality of upper repeats in said longitudinal thread direction.

17. The paper machine mesh according to claim 14, wherein said plurality of upper transverse threads to said plurality of lower transverse threads comprises a ratio which is greater than 1.

18. The paper machine mesh according to claim 14, wherein said plurality of upper transverse threads to said plurality of lower transverse threads comprises a ratio which is 2:1.

19. The paper machine mesh according to claim 14, wherein said plurality of upper transverse threads to said plurality of lower transverse threads comprises a ratio which is 3:2.

20. The paper machine mesh according to claim 14, wherein said plurality of upper transverse threads to said plurality of lower transverse threads comprises a ratio which is 4:3.

21. The paper machine mesh according to claim 14, wherein each of said plurality of upper repeats of said upper fabric layer comprises at least 14 of said plurality of upper transverse threads.

22. The paper machine mesh according to claim 14, wherein said lower fabric layer comprises a repeat including at least seven of said plurality of lower transverse threads.

23. The paper machine mesh according to claim 14, wherein said plurality of tie threads comprise seven of said plurality groups, each of said plurality of groups including of two of said plurality of tie threads.

24. The paper machine mesh according to claim 23, wherein at least 24 of at least one of said plurality of longitudinal threads and said plurality of upper and said plurality of lower transverse threads comprise a complete repeat of the paper machine mesh.

25. The paper machine mesh according to claim 23, wherein at least 26 of at least one of said plurality of longitudinal threads and said plurality of upper and said plurality of lower transverse threads comprise a complete repeat of the paper machine mesh.

26. The paper machine mesh according to claim 23, wherein at least 32 of at least one of said plurality of longitudinal threads and said plurality of upper and said plurality of lower transverse threads comprise a complete repeat of the paper machine mesh.

27. The paper machine mesh according to claim 23, wherein at least 48 of at least one of said plurality of longitudinal threads and said plurality of upper and said plurality of lower transverse threads comprise a complete repeat of the paper machine mesh.

28. The paper machine mesh according to claim 14, wherein said plurality of upper transverse threads and said plurality of lower transverse threads comprise a plurality of transverse threads, said plurality of tie threads being a plurality of warp threads and said plurality of transverse threads being a plurality of weft threads.

29. The paper machine mesh according to claim 14, wherein said plurality of upper transverse threads and said plurality of lower transverse threads comprise a plurality of transverse threads, said plurality of tie threads being a plurality of weft threads and said plurality of transverse threads being a plurality of warp threads.

* * * * *